US007824152B2

(12) United States Patent
Morrison

(10) Patent No.: US 7,824,152 B2
(45) Date of Patent: Nov. 2, 2010

(54) MULTIVANE SEGMENT MOUNTING ARRANGEMENT FOR A GAS TURBINE

(75) Inventor: Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 752 days.

(21) Appl. No.: 11/801,307

(22) Filed: May 9, 2007

(65) Prior Publication Data

US 2008/0279679 A1 Nov. 13, 2008

(51) Int. Cl.
*F01D 9/04* (2006.01)

(52) U.S. Cl. ..... 415/135; 415/136; 415/200; 415/209.3; 415/209.4; 415/210.1

(58) Field of Classification Search ..... 415/134, 415/135, 136, 138, 139, 200, 209.2, 209.3, 415/209.4, 210.1
See application file for complete search history.

(56) References Cited

U.S. PATENT DOCUMENTS 3,558,237 A * 1/1971 Wall ..... 415/115
3,992,127 A * 11/1976 Booher et al. ..... 415/136
4,793,770 A * 12/1988 Schonewald et al. ..... 415/190
5,181,827 A 1/1993 Pellow et al.
5,188,506 A 2/1993 Creevy et al.
5,630,700 A * 5/1997 Olsen et al. ..... 415/134
6,200,092 B1 3/2001 Koschier
6,464,456 B2 10/2002 Darolia et al.
6,648,597 B1 11/2003 Widrig et al.
7,090,459 B2 8/2006 Bhate et al.
7,093,359 B2 8/2006 Morrison et al.
7,114,917 B2 10/2006 Legg
7,179,524 B2 2/2007 Merrill et al.
2003/0002979 A1* 1/2003 Koschier ..... 415/115
2005/0076504 A1* 4/2005 Morrison et al. ..... 29/889.72
2006/0062673 A1 3/2006 Coign et al.
2006/0217933 A1 9/2006 Holi et al.
2006/0222487 A1 10/2006 Au
2006/0228211 A1 10/2006 Vance et al.
2006/0292001 A1 12/2006 Keller et al.
2007/0017225 A1 1/2007 Bancalari et al.
2007/0020090 A1 1/2007 Giaimo et al.

* cited by examiner

*Primary Examiner*—Edward Look
*Assistant Examiner*—Jesse Prager

(57) ABSTRACT

A mounting arrangement (10) for a multivane segment (12) of ceramic matrix composite (CMC) composition positioned between outer and inner metallic rings (14, 16). Selected ones of the vanes (18*a*) of the multivane segment surround internal struts (24) joining the outer and inner rings. Spring members (26, 28) accommodate differential thermal growth between the multivane segment and the outer and inner rings, and a compliant material (30) seals against gas leakage around the segments.

20 Claims, 3 Drawing Sheets

MULTIVANE SEGMENT MOUNTING ARRANGEMENT FOR A GAS TURBINE

FIELD OF THE INVENTION

The invention in general relates generally to gas turbines, and particularly to a novel vane arrangement for a gas turbine.

BACKGROUND OF THE INVENTION

The turbine section of a gas turbine is comprised of a plurality of stages, each including a set of stationary vanes and a set of rotating blades. Hot gas is directed through the vanes to impinge upon the blades causing rotation of turbine rotor assembly to which they are connected. The power imparted to the rotor assembly may be used to rotate other machinery such as an electric generator, by way of example.

Advanced turbine systems have been developed which use vanes made of ceramic matrix composite material which can withstand much higher temperatures than conventional metal vanes. These high temperature vanes are connected to a metallic support arrangement. A problem arises however, in that the ceramic vanes have a substantially different coefficient of thermal expansion than the metal support structure such that when heated and cooled, the vanes and support structure expand and contract at different rates leading to undesirable thermal stresses. This problem is exacerbated in multivane segments wherein at least two vane airfoils are joined between common inner and outer shrouds. The present invention solves this problem.

BRIEF DESCRIPTION OF THE DRAWINGS

The invention is explained in the following description in view of the drawings that show.

DETAILED DESCRIPTION OF THE INVENTION

Figure 1:
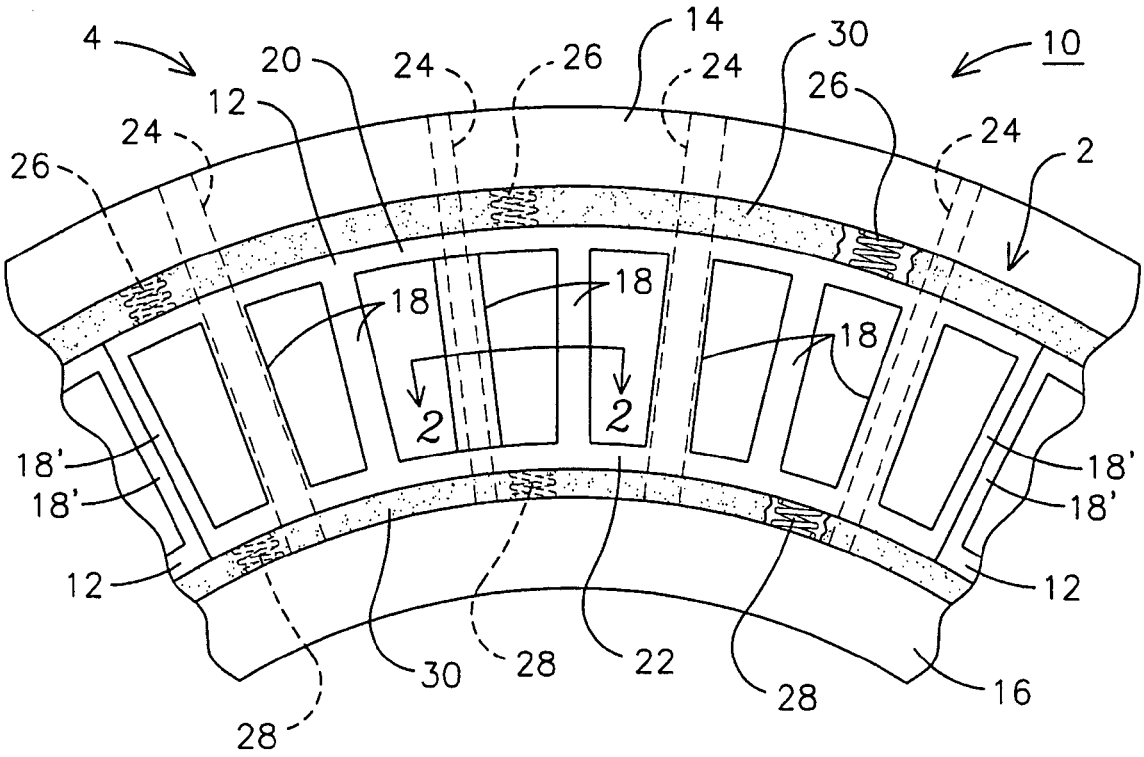
FIG. 1 is an axial view of one embodiment of the present invention.

FIG. 1 is a partial view of a vane stage 2 of a gas turbine engine 4 as viewed along an axis of the turbine rotor (not shown) and illustrating a multivane segment mounting arrangement 10. The multivane segment mounting arrangement 10 includes a plurality of multivane segments 12 positioned between an outer ring 14 and an inner ring 16, which in turn are connected directly or indirectly to the turbine casing structure (not illustrated). The outer ring 14 and inner ring 16 may be constructed of metal alloy materials as are known in the art. The multivane segment 12 is formed of a specialized material which has a different coefficient of thermal expansion than the outer and inner rings 14 and 16. In one embodiment, the multivane segment 12 is formed of a ceramic matrix composite (CMC) material. A wide range of CMCs have been developed that combine a matrix material with a reinforcing phase of a different composition. Such CMCs combine high temperature strength with improved fracture toughness, damage tolerance and thermal shock resistance.

The multivane segment 12 is an arcuate-shaped hollow CMC shell which includes a plurality of vanes 18 which extend between, and may be integral with, an outer shroud 20 and an inner shroud 22. FIG. 1 shows each multivane segment

12 as including eight vanes (airfoils) 18, although other quantities of vanes may be used per segment, and not all segments may be identical. In the embodiment of FIG. 1, the opposed ends of each segment 12 include sectioned vanes 18' (typically approximately half vanes divided along a radially oriented plane) which will join and seal with corresponding sectioned vanes of an adjacent abutting multivane segment 12 to define the shape of a complete vane 18. Accordingly, if there are forty eight vanes around the turbine, there would be six such multivane segments 12 defining the vane stage 2. In other embodiments no sectioned vanes may be used and the segments may abut along portions of the shrouds 20, 22 between adjacent vanes 18.

Extending between and joined to outer and inner rings 14 and 16 is a plurality of load bearing struts 24 which may be welded or bolted or otherwise connected to the outer and inner rings. The struts 24 pass through selected vanes of the multivane segments 12 which are free to move radially inwardly and outwardly on the struts 24. The vanes surrounding the struts 24 are illustrated to have a somewhat different shape than the other vanes in order to accommodate the struts, but in other embodiments all vanes may be identical. The struts 24 function to resist rotational and/or axial forces exerted on the vane stage 2 while allowing radial movement of the segments 12 relative to the inner and outer metallic rings 14, 16. Other structures may be used in combination with the struts 24 to convey loads from the segments 12 to the turbine casing, such as stops (not shown) formed on the segments 12 for abutting respective support surfaces (not shown) on the outer and/or inner rings 14, 16. The multivane segment 12 is held in suspension between, and may be prevented from contacting, the rings 14, 16 by means of biasing members such as spring members 26 positioned between the outer shroud 20 and outer ring 14, and spring members 28 positioned between the inner shroud 22 and inner ring 16. The spring members 26 and 28 not only serve to maintain the multivane segment 12 at a position between the outer and inner rings 14 and 16, but also provide preload for resisting vibration and provide some compliance against differential thermal growth driving forces. Although coil springs are shown in the illustrated embodiment, other types of spring members, such as Belleville springs or wave springs for example, may be used. Relative thermal growth between the ceramic and metal structures results in either more or less preload on either the inner springs 28 or outer springs 26, thus maintaining the vane segments in a resulting radial position between the rings 14, 16 responsive to the temperature condition. The radially oriented struts 24 also serve to control thermal distortion of the ceramic vane segments 12. The vane segments 12 will find a best fit location between the inner and outer rings 14, 16 at any given temperature condition. In one embodiment, assembly is envisioned via insertion of the struts 24 through the outer ring 14 and vane segment 12 for attachment to the inner ring 16.

Proximate the spring members 26 and 28 and disposed between the ring segments 12 and at least one of the rings 14, 16 may be a compliant material 30 which allows relative movement between the multivane segment 12 and the respective ring 14, 16 while serving to restrict gas flow around the multivane segment 12. Portions of the compliant material 30 are sectioned away in the figure at selected locations to show spring members 26 and 28. Other mechanisms for limiting gas flow around the segments may be used in lieu of or together with the compliant material 30, such as a compliant seal mechanism such as stacked E-seals for example.

Figure 2:
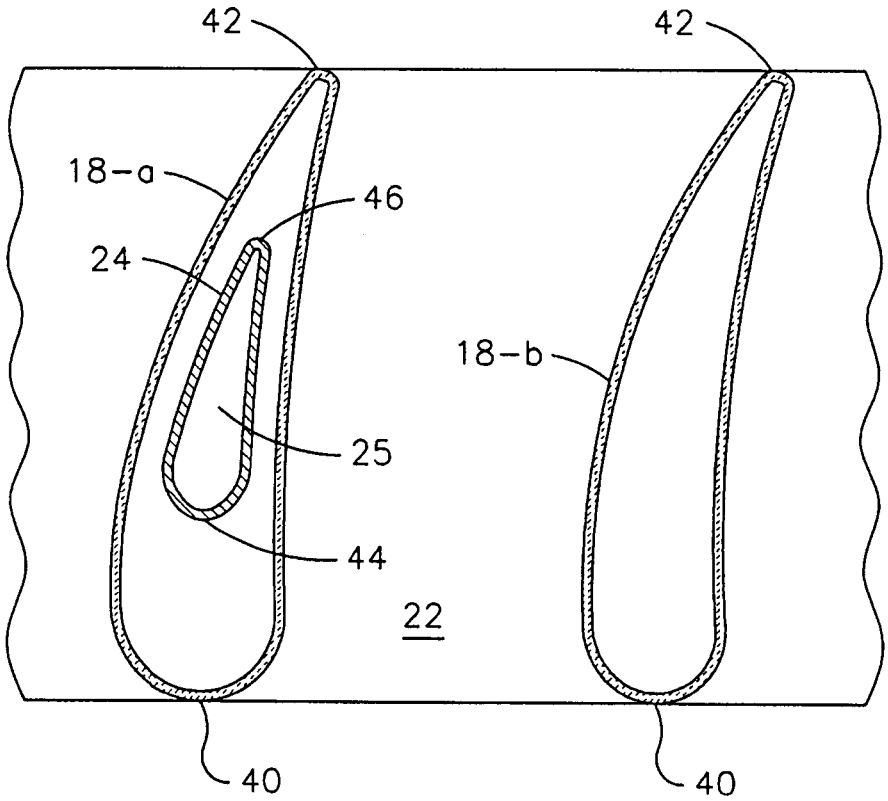
FIG. 2 is a view along the line 2-2 of FIG. 1.
Figure 3:
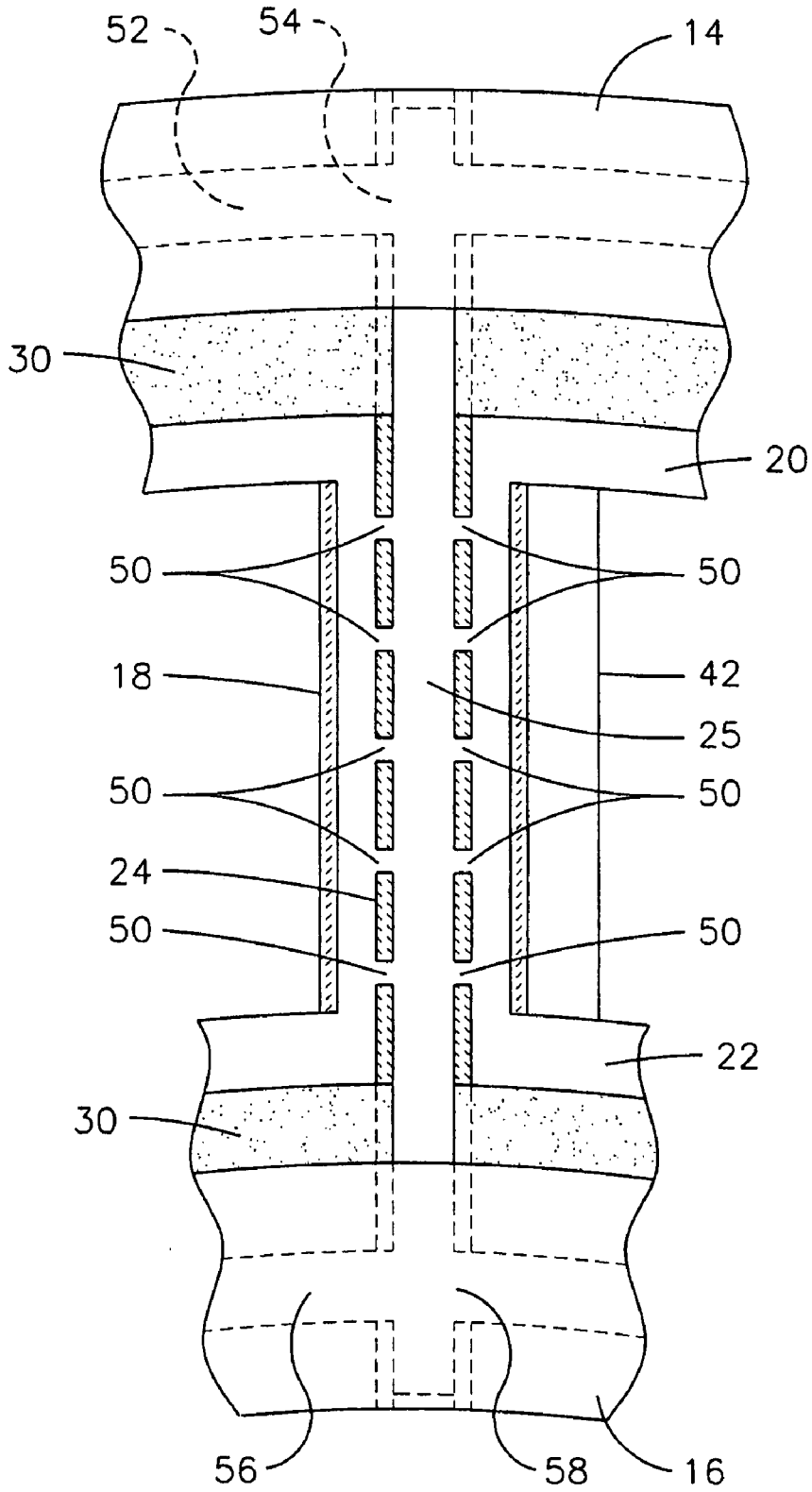
FIG. 3 illustrates a cooling arrangement for one embodiment of the invention.

FIG. 2 illustrates a cross-sectional view taken along line 2-2 of FIG. 1. As illustrated in FIG. 2, each vane 18-*a* and 18-*b* is in the shape of an airfoil having a rounded leading edge 40 and a tapered trailing edge 42. Strut 24 passes through the center of vane 18*a* but not through the adjacent vane 18*b*. The strut 24 of this embodiment has an airfoil shape with a rounded leading edge 44 and a tapered trailing edge 46, somewhat mirroring the airfoil shape of the surrounding vane. Although the strut 24 may be of a solid metal, it is illustrated as being hollow with a center passageway 25. This not only saves weight, but also allows for cooling, if desired, as depicted in FIG. 3. The strut 24 is illustrated as not contacting the inner surface of the vane, however, in other embodiments, the strut may provide direct physical contact and support against the vane to resist axial rotation forces exerted on the vane by the passing gas stream, such as is illustrated by the phantom location of others of the struts of FIG. 1. For one embodiment where a strut does not contact the vane, the load path may be as follows: pressure load on the vane is taken up by the inner and outer shroud flanges, which in turn transfer loads onto the respective inner and outer rings; and the inner ring load is transferred to the outer casing (ground) via the strut. Thus, the strut does not have to contact the vane directly to carry its load.

FIG. 3 is a partial cross sectional axial view of a single vane 18 with an interior strut 24. Cooling of the vanes 18 may be accomplished in a variety of ways, one of which is illustrated in FIG. 3. More particularly, strut 24 has a series of apertures 50 to allow for cooling gas passage along a radial length of the vane 18. An interior channel in one of the rings carries cooling gas from a source (not illustrated). In the embodiment of FIG. 3, a cooling gas supply channel 52 is interior to the outer ring 14 and is in gas communication with strut 24 via an opening 54 in the strut. Cooling gas passes through strut 24 and out apertures 50 to provide the cooling function for the strut 24 and for the vane 18. Cooling gas may exit through an interior channel 56 in inner ring 16 via opening 58 in the strut 24. Other cooling arrangements may be envisioned within the scope of this invention, such as passing cooling gas only between the strut and the vane, for example. Other means for conveying a cooling fluid to the strut center passageway 25 may be envisioned including dedicated supply lines to each strut, or reversing the direction of flow described above and passing cooling fluid into the passageway 25 through apertures 50, for example.

Figure 4:
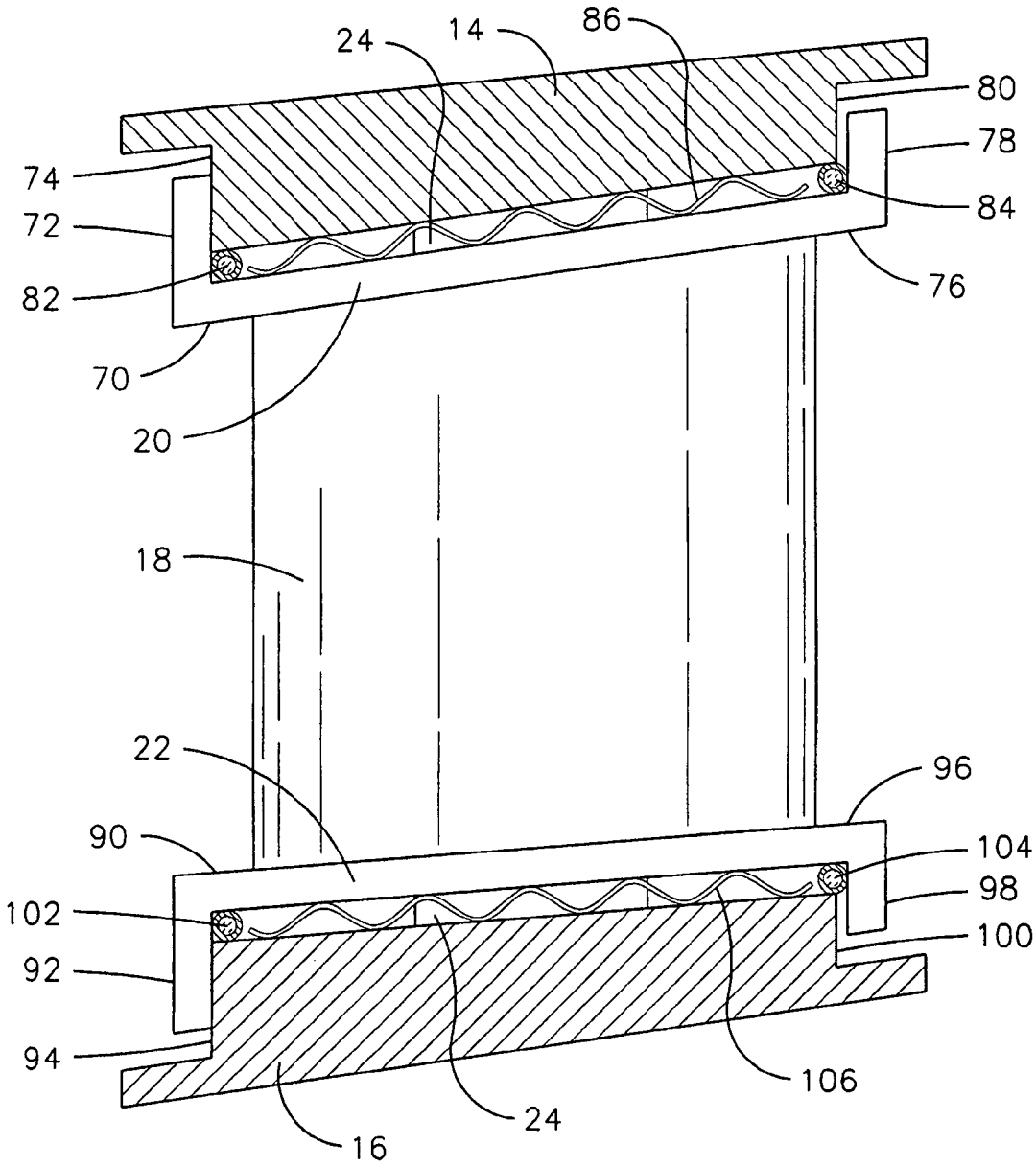
FIG. 4 is a side view illustrating a sealing arrangement for one embodiment of the invention.

In lieu of or in addition to using compliant material 30 to perform a sealing function, FIG. 4 illustrates a second method of sealing the space between the multivane segment 12 and the rings 14, 16. More particularly, FIG. 4 shows a side view of a vane 18 along within its outer and inner shrouds 20 and 22. Outer shroud 20 includes a front flange 70 which extends beyond the vane 18, and which includes a front radially extending portion 72. This front radially extending portion 72 is adjacent a front surface portion 74 of outer ring 14. In a similar manner, outer shroud 20 includes a back flange 76 which extends beyond the vane 18, and which includes a back radially extending portion 78. This back radially extending portion 78 is adjacent a back surface portion 80 of outer ring 14. During operation, due to dynamic forces, the front radially extending portion 72 may actually touch front surface portion 74 of outer ring 14, while the back radially extending portion 78 may be slightly displaced from back surface portion 80. Sealing may be accomplished with the provision of a first rope seal 82 positioned between the front flange 70 and outer ring 14 as well as a second rope seal 84, positioned between back flange 76 and outer ring 14. The function of springs 26 of FIG. 1 is accomplished in the embodiment of FIG. 4 with an undulating wave spring 86 positioned between outer ring 14 and outer shroud 20.

A similar arrangement may be provided for the inner shroud 22. FIG. 4 illustrates inner shroud 22 as including a front flange 90 which extends beyond the vane 18, and which includes a front radially extending portion 92. This front radially extending portion 92 is adjacent a front surface portion 94 of inner ring 16. In a similar manner, inner shroud 22 includes a back flange 96 which extends beyond the vane 18, and which includes a back radially extending portion 98. This back radially extending portion 98 is adjacent a back surface portion 100 of inner ring 16 Sealing is accomplished with the provision of a first rope seal 102 positioned between the front flange 90 and inner ring 16 as well as a second rope seal 104 positioned between back flange 96 and inner ring 16. The function of springs 28 in FIG. 1 is accomplished with an undulating wave spring 106 positioned between inner ring 16 and inner shroud 22.

When compared to the use of single ceramic vane segments, the use of multivane segments provides a reduction in the number of parts and a reduction in the number of air leakage paths. The mounting arrangement envisioned herein allows for the use of rigid, redundant load path, ceramic structures with relatively few attachment points to the metallic supporting structure, and it accommodates differential thermal growth there between.

While various embodiments of the present invention have been shown and described herein, it will be obvious that such embodiments are provided by way of example only. Numerous variations, changes and substitutions may be made without departing from the invention herein. For example, while the metallic mounting rings are generally considered to be complete hoops or split hoops with mating flanges with a rigidly attached inner ring such as a gas turbine inner seal housing structure, the inner structure may not necessarily be a full hoop. Further all vane airfoils may not have the same geometry, such as when vanes surrounding supporting struts have a somewhat different shape (such as fatter) to accommodate the struts. Also, the mounting arrangement described herein may be used for other nozzle-type structures such as in steam turbines. Accordingly, it is intended that the invention be limited only by the spirit and scope of the appended claims.

The invention claimed is:

1. A vane mounting arrangement for a gas turbine engine comprising:

a plurality of multivane segments collectively defining a vane stage, each segment comprising a plurality of vanes extending between an inner shroud and an outer shroud, each segment comprising a ceramic matrix composite material;

an inner ring comprising a metallic material;

an outer ring comprising a metallic material;

a plurality of struts connected between the inner ring and the outer ring and extending through respective selected ones of the vanes; and a plurality of biasing members disposed between the segments and the respective inner ring and outer ring for preloading the segments into position between the rings and for accommodating differential thermal expansion there between.

2. The vane mounting arrangement of claim 1, further comprising compliant material disposed between the segments and at least one of the inner ring and the outer ring for accommodating relative movement between the segments and the respective ring while restricting gas passage there between.

3. The vane mounting arrangement of claim 1, further comprising:

the struts comprising a center passageway; and a means for conveying a cooling fluid into the center passageway.

4. The vane mounting arrangement of claim 3, wherein the struts each comprise at least one aperture along a radial length of the respective vane for exhausting the cooling fluid.

5. The vane mounting arrangement of claim 1, wherein each strut comprises an airfoil shape.

6. The vane mounting arrangement of claim 1, further comprising:

at least one of the outer shroud and the inner shroud comprising a radially extending portion extending proximate an opposed surface of a respective at least one of the outer ring and the inner ring; and a seal disposed between the radially extending portion and respective opposed surface.

7. The vane mounting arrangement of claim 6, wherein the seal comprises a rope seal.

8. The vane mounting arrangement of claim 1, wherein the biasing members comprise one of an undulating wave spring, a coil spring and a Belleville spring.

9. The vane mounting arrangement of claim 1, wherein each segment comprises a sectioned vane at each opposed end, with adjoining sectioned vanes of abutting segments defining a respective complete vane.

10. The vane mounting arrangement of claim 1, wherein vanes receiving a strut comprise a shape different than vanes not receiving a strut.

11. A gas turbine engine comprising the vane mounting arrangement of claim 1.

12. A vane mounting arrangement for a gas turbine engine comprising:

a ceramic matrix composite vane stage comprising a plurality of multivane segments positioned in an abutting end-to-end arrangement;

a metallic support structure for supporting the plurality of multivane segments in the abutting end-to-end arrangement within a gas turbine engine, the metallic support structure further comprising:

a radially outer support for resisting movement of the vane stage in a radially outward direction;

a radially inner support for resisting movement of the vane stage in a radially inward direction;

a plurality of radially extending members arranged between the radially outer support and the radially inner support, each radially extending member disposed within a respective selected vane of the vane stage for relative radial movement there between, wherein fewer vanes are selected than are present; and a first spring biasing member disposed between the vane stage and the radially outer support and a second spring biasing member disposed between the vane stage and the radially inner support;

the first and second spring biasing members cooperating to position the vane stage at a radial position between the radially outer support and the radially inner support responsive to a differential thermal growth condition existing between the ceramic matrix composite vane stage and the metallic support structure.

13. The vane mounting arrangement of claim 12, further comprising a sealing member disposed between the vane stage and at least one of the radially outer support and the radially inner support for blocking a gas flow there between.

14. The vane mounting arrangement of claim 12, further comprising a cooling gas passage formed in at least one of the radially outer support and the radially inner support in fluid communication with a passageway formed in each radially extending member.

15. The vane mounting arrangement of claim 12, wherein a portion of at least one of the radially extending members is in contact with its respective vane for resisting relative rotation there between.

16. The vane mounting arrangement of claim 12. wherein vanes receiving a radially extending member comprise a shape different than vanes not receiving a radially extending member.

17. A gas turbine engine comprising the vane mounting arrangement of claim 12.

18. A mounting arrangement comprising:

a ceramic nozzle structure comprising a plurality of arcuate-shaped vane segments;

a plurality of radially oriented struts connecting between an inner metallic support structure and an outer metallic support structure, wherein the struts support the plurality of vane segments in an abutting end-to-end arrangement within a gas turbine engine, each of the struts passing through a portion of a respective vane segment for resisting rotation of the ceramic nozzle structure while allowing radial movement of the vane segments relative to the inner and outer metallic support structures; and biasing members for positioning the ceramic structure at a relative position between the inner and outer metallic support structures responsive to a temperature condition causing differential thermal growth between the ceramic structure and the inner and outer metallic support structures.

19. The mounting arrangement of claim 18, further comprising:

each segment comprising a plurality of airfoils; and each strut comprising an airfoil shape disposed within a respective one of the plurality of segment airfoils.

20. A gas turbine engine comprising the mounting arrangement of claim 18.

* * * * *